United States Patent [19]

Gelman

[11] 4,258,597

[45] Mar. 31, 1981

[54] SOCKET WRENCH EJECTOR

[76] Inventor: Alan H. Gelman, 8223 Calle Calzada, San Diego, Calif. 92126

[21] Appl. No.: 51,365

[22] Filed: Jun. 25, 1979

[51] Int. Cl.[3] ..... B25B 23/00

[52] U.S. Cl. ..... 81/184

[58] Field of Search ..... 81/177 G, 180 R, 184

[56] References Cited

U.S. PATENT DOCUMENTS

| | | | |
|---|---|---|---|
| 3,138,984 | 6/1964 | Penner | 81/184 |
| 3,815,451 | 6/1974 | Penner | 81/177 G X |

*Primary Examiner*—James G. Smith

[57] ABSTRACT

A device for positive ejection of cylindrical socket wrenches from a retaining square-drive is disclosed consisting primarily of a lever mounted on the shaft of a typical ratchet-driven socket wrench parallel to the shaft. A flat fork in one end of the lever is placed around the square-drive at its base and under a retained socket. A fulcrum at the midpoint of the lever rests on the shaft of the wrench and the lever is retained by a spring clip surrounding both the lever and the shaft. Depression of one end of the lever raises the fork end lifting the socket from the square drive and the spring clip returns the lever to its initial position.

2 Claims, 6 Drawing Figures

SOCKET WRENCH EJECTOR

BACKGROUND OF THE INVENTION

Wrenches for placement and removal of threaded nuts and automotive and other mechanical applications have long been in common use. Cylindrical sockets are machined to closely fit the nut to be driven at one end of the hollow cylinder and the other end of the hollow cylinder is machined to receive a square driving member. Torque is applied to the driving member and thus to the socket and nut by means of a wrench handle mounted perpendicular to the square drive and the axis of the cylinderical socket. Thus large amounts of leveraged torque can be applied to the nut.

Typically the cylindrical socket is retained on the square drive by means of a small depressable metal ball contained by and protruding from one face of the square-drive to engage a groove in the interior of the cylindrical socket. The within invention concerns removal of the cylindrical socket from the square-drive of the wrench after the torquing operation is finished either for storage of the tool or to replace the socket with a different size for another operation. Removal of the sockets can be difficult when the operations involve high torque which can jam the cylindrical socket on the square-drive and because the work environment may involve grease and oil which accumulate on the wrench and render grasping and removal of the socket difficult.

Further the detent ball necessary to hold the socket in position provides sometimes difficult resistance in removing the socket.

A number of devices in the prior art have addressed the need for release of the detent and ejection of the socket. Mechanisms internal to the square-drive itself have been provided to release the detaining force of the detent ball and allowing the socket to drop off. However these do not forceably eject the socket or release binding forces between the square-drive and socket itself that may result from high-torque applications. These devices are typically actuated by a spring-loaded pushbutton which may itself be subject to jamming of its moving parts by accumulation of grease and dirt.

Thus it is an object of the within invention to provide a means of positive ejection of cylindrical sockets from a square-drive wrench that will overcome any binding force between the socket and wrench.

A further objective of the within invention is to provide a socket ejection mechanism that can be adapted to any existing square-drive socket wrench.

Another object of the invention is to provide a means of ejecting sockets from a square-drive wrench that will not jam or become inoperative by accumulation of dirt and grease.

SUMMARY OF THE INVENTION

The invention here described seeks to accomplish the above objectives by providing a simple lever mechanism that can be mounted on any standard square-drive socket wrench, and, without interfering with the function of the socket wrench, simply and positively remove a detained socket from the square drive by depressing one end of the lever to lift the other end which is inserted between the socket and drive wrench. The lever can be shaped of a metallic material containing a fulcrum point at its center with one broad flat end fork or crescent shape to fit around the square drive and under the socket when it is mounted on the drive-wrench. The lever is attached to the shaft of the drivewrench at or near the fulcrum point and can be spring-loaded to return to its static position after actuation. Depression of one end of the lever will raise the fork end in seesaw fashion a distance sufficient to positively break the cylindrical socket free of its detent position, overcoming the detaining force of the square-drive detent ball and any binding forces imposed between the socket and the square-drive. Since the lever imposes a direct lifting force on the socket, and does not depend on friction or gravity to provide a removing force on the socket, the presence of grease, oil or dirt has no effect on the function of the ejector lever.

Since the within invention involves only one moving part and since it can be adapted to any configuration of a right-angle square-drive socket wrench, it provides a simple and significant advance over the contrived and non-positive release mechanisms described in prior art and thus the invention accomplishes the objectives stated above in the most direct and inexpensive way possible.

DESCRIPTION OF THE PREFERRED EMBODIMENT

Figure 1:
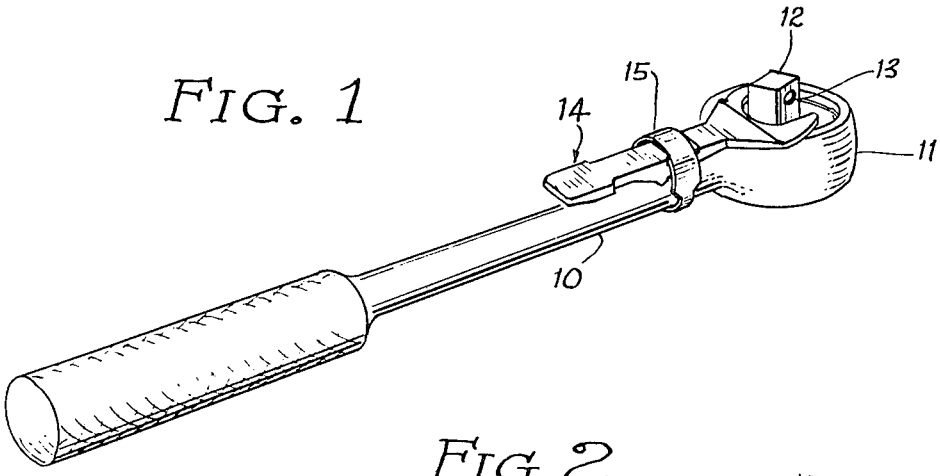
FIG. 1 is a perspective view of the ejector lever mounted on a typical square-drive ratchet wrench.

Referring to the drawings FIG. 1 shows the concept applied to a commonly available square-drive ratchet wrench. The lever is mounted parallel to the shaft of the wrench 10. The wrench typically includes a roughly circular head 11 which may contain a ratchet mechanism and engages the cylindrical socket wrench by means of a squaring-driving member 12. The cylindrical socket contains in one end of the hollow cylinder a square aperture to closely fit the square-drive and is retained in position on the square-driving member by a spring-loaded or friction-fit detent ball 13. which engages an internal groove in the cylindrical socket. The invention consists simply of a lever arm 14 retained to the shaft of the wrench by a spring band 15.

Figure 2:
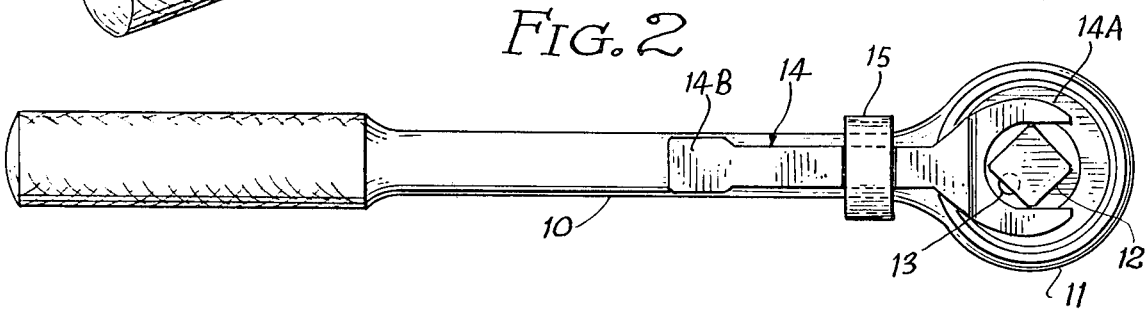
FIG. 2 is a plan view of the ejector lever mounted on a typical ratchet wrench.

FIG. 2 further illustrates in plan view the shape of the lever arm 14, at one end flattened to a crescent fork-shape 14A, the opening of which fits closely around the square-drive allowing room for the square-drive to turn freely through its range of axial motion. The opposite end of the lever is shaped to a tab 14B. In operation, the user grasps the knurled handle of the wrench and at the end of the wrenching operation may remove the socket from its engagement on the square-drive by depressing the tab 14B with his thumb, raising the fork end of the lever 14A.

Figure 3:
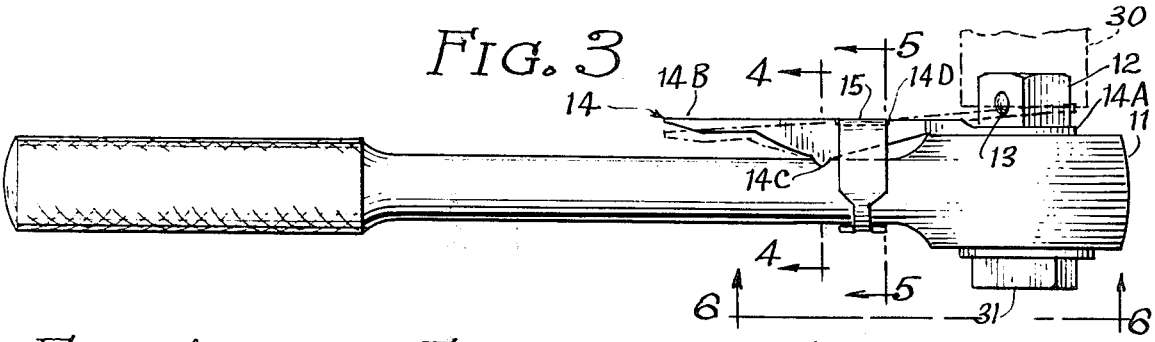
FIG. 3 is a side view of the ejector lever mounted on a typical ratchet wrench showing the actuated position of the lever and the ejected cylindrical socket in shadow view.

FIG. 3 further illustrates the ejection mechanism and the configuration of the lever 14. The flat fork end 14A is shown resting on the face of the ratchet head and between the ratchet head and the cylindrical socket 30 shown in shadow-view fitter over the square-drive. The lever pivots on a fulcrum point 14C. A retaining groove in the lever 14D engages a spring band 15 which secures the lever in position on the shank of the wrench. The ratchet switch 31 at the opposite side of the ratchet head from the square-drive is also visible in this view. In operation, as previously described, the user presses down with his thumb on lever tab 14B; the depressed position of tab 14B is shown in shadow-view. The corresponding position of the fork end 14A is shown in shadow-view. Thus the pivot action of the lever forces the fork end to move through a distance separating the ratchet head from the detained cylindrical socket. The distance of movement is sufficient to break the detent ball 13 out of the internal retaining groove and allow the socket to fall free. The spring band 15 while retaining the lever will expand slightly as the lever is depressed and the resilient action of the spring causes the lever to be returned to the unactuated position when released.

Figure 4:
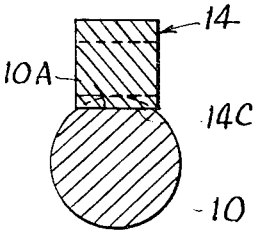
FIG. 4 is a cross-section along line 4—4 of FIG. 3 through the lever and wrench shaft.
Figure 5:
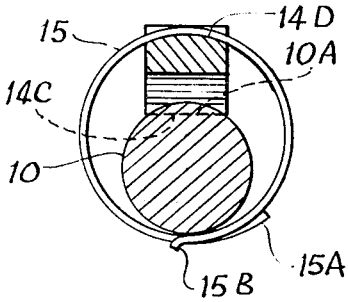
FIG. 5 is a cross-section along line 5—5 of FIG. 3 disclosing the lever wrench shaft and retaining spring-clip.

FIG. 4 reveals in cross-section that the fulcrum 14C of lever 14 can be further secured in position relative to the wrench shank 10 by means of a flat retaining groove 10A filed into the cylindrical shank, enabling the mating of the two elements. Another method of preventing the fulcrum from slipping from the shank either separately or in conjunction with the mating groove would be to insert a friction spacer of rubber or a like material between the shank and fulcrum that would prevent slippage between the two. FIG. 5 further details the retention of the lever 14 on shank 10 by the spring band 15. The spring band fits into a groove 14D in the lever preventing separation of the fulcrum 14C from the shank groove 10A. The spring itself may resiliently expand and contract as the lever is actuated as the spring circle is opened allowing an expanding movement between spring ends 15A and 15B.

Figure 6:
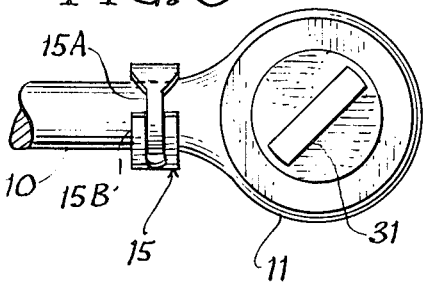
FIG. 6 is a further detail from the backside of the typical ratchet wrench detailing the spring clip mechanism.

FIG. 6 further illustrates the engagement of spring ends 15A as a tongue between the guiding forks 15B. Thus it can be seen that the spring can allow expansion but will firmly return to its initial position.

Having thus described my invention, I claim:

1. An ejector lever for use on a wrench having a shaft and a head housing a square socket drive, said ejector lever comprising an elongated lever having at one end a flat open-ended fork adapted to surround the square-drive at its base and under an attached socket, a fulcrum resting on the shaft of the wrench at the mid-point of the lever such that depression of the opposite lever end will lift the fork end and thereby release the socket from its detent, and means for securing the lever to the wrench shaft and returning it to initial position after actuation, said means comprising a laterally-cut retaining groove in said shaft and a spring band encircling said lever and shaft and releasably retaining said fulcrum in said groove such that said lever can be alternatively snapped out of said groove and slid axially along said shaft free of said head, or operatively positioned with said fulcrum engaged in said groove.

2. The device of claim 1 wherein said spring band is of the constrictive type and engages said lever at a point thereon longitudinally displaced toward said head from said fulcrum such that said spring band is triple purpose, serving to bias said fork against said head, retain said lever laterally against said shaft, and also cooperate with said groove to create a positive detent for use when longitudinally shifting said lever between its operative and passive modes.

* * * * *